United States Patent [19]

Krein

[11] Patent Number: 4,863,339

[45] Date of Patent: Sep. 5, 1989

[54] VACUUM ASSISTED METHOD FOR INSTALLING A WATERPROOF LINER

[75] Inventor: Reuben Krein, Fort Smith, Ark.

[73] Assignee: BJK Industries, Inc., Fort Smith, Ark.

[21] Appl. No.: 241,770

[22] Filed: Sep. 7, 1988

Related U.S. Application Data

[63] Continuation of Ser. No. 863,093, May 14, 1986, abandoned, which is a continuation of Ser. No. 733,962, May 14, 1985, abandoned, which is a continuation-in-part of Ser. No. 502,696, Jun. 9, 1983, Pat. No. 4,516,906.

[51] Int. Cl.[4] ..... B65D 88/12

[52] U.S. Cl. ..... 414/786; 414/373; 414/572; 414/467; 220/461; 220/403; 220/404; 222/105

[58] Field of Search ..... 414/786, 572, 373, 293, 414/398, 467; 406/38; 222/105; 105/355, 423; 220/403, 85 B, 410, 461, 462; 296/37, 39 R

[56] References Cited

U.S. PATENT DOCUMENTS

| | | | |
|---|---|---|---|
| Re. 29,721 | 8/1978 | Ukmar et al. | 220/403 X |
| 2,079,461 | 3/1937 | MacMillan, Jr. | 52/2 X |
| 2,352,503 | 6/1944 | Walton | 220/404 X |
| 2,364,012 | 11/1944 | Walton et al. . | |
| 2,758,747 | 8/1956 | Stevens | 220/461 X |
| 2,910,994 | 11/1959 | Joy . | |
| 2,989,213 | 6/1971 | Daggitt | 220/404 X |
| 2,991,906 | 7/1961 | Eligoulachvili | 220/403 |
| 3,035,590 | 5/1962 | Helmers . | |
| 3,068,561 | 12/1962 | Jones | 220/404 X |
| 3,159,165 | 12/1964 | Cohen et al. | 52/2 X |
| 3,250,024 | 5/1966 | Douthitt et al. . | |
| 3,254,457 | 6/1966 | Gedney | 52/2 |
| 3,335,529 | 8/1967 | Gedney . | |
| 3,367,087 | 2/1968 | Jarund | 53/385 X |
| 3,389,510 | 6/1968 | Stock | 52/2 |
| 3,478,472 | 11/1969 | Kwake | 52/2 X |
| 3,696,952 | 10/1972 | Bodenheimer | 220/404 X |
| 3,769,763 | 11/1973 | Kwake | 52/2 |
| 3,783,766 | 1/1974 | Boucher | 52/2 X |
| 3,802,157 | 4/1974 | Elms et al. | 53/385 |
| 3,898,775 | 8/1975 | Webb | 52/2 |
| 3,924,364 | 12/1975 | Eerkens | 52/2 |
| 4,031,674 | 6/1977 | Rand | 52/2 |
| 4,103,369 | 8/1978 | Riordan | 52/2 X |
| 4,232,803 | 11/1980 | Muller et al. | 220/404 X |
| 4,484,420 | 11/1984 | Stokes | 52/2 |
| 4,516,906 | 5/1985 | Krein | 414/786 |

FOREIGN PATENT DOCUMENTS

| | | | |
|---|---|---|---|
| 6918892 | 6/1970 | Netherlands | 222/105 |

*Primary Examiner*—Frank E. Werner

*Attorney, Agent, or Firm*—Ross, Howison, Clapp & Korn

[57] ABSTRACT

A method for disposing a waterproof liner in a container includes disposing a bag within the container and attaching the peripheral edges at the opening of the bag to the peripheral edges of the container opening. A negative pressure is then formed in the space between the bag and the inner walls of the container to cause the sides of the liner to move toward the sides of the container and adhere thereto.

8 Claims, 3 Drawing Sheets

FIG. 7
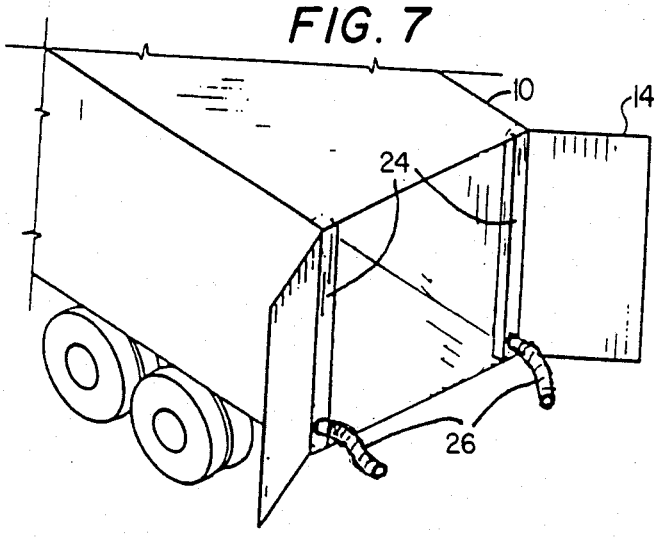
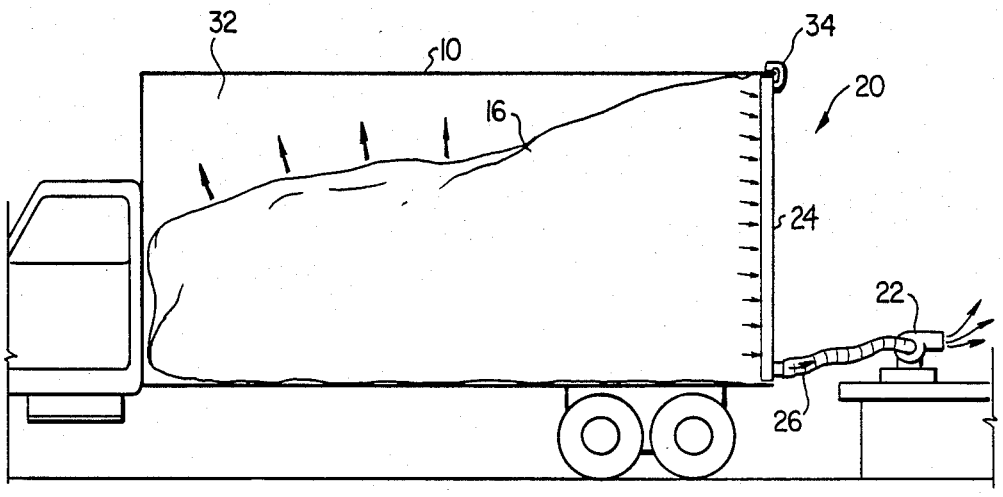
FIG. 8

VACUUM ASSISTED METHOD FOR INSTALLING A WATERPROOF LINER

CROSS REFERENCE TO RELATED APPLICATIONS

This application is a continuation of Ser. No. 863,093, now abandoned which is a continuation in part of Ser. No. 733,962 filed 5/14/85, now abandoned which is a continuation in part of U.S. Pat. No. 4,516,906 issued on May 14, 1985.

TECHNICAL FIELD OF INVENTION

The present invention pertains in general to waterproof liner installation systems for cargo containers and, more particularly, to a liner installation system utilizing only vacuum.

BACKGROUND OF INVENTION

The basic concept of providing a semi-truck trailer with a liner and ancillary support equipment has been generally proposed in the past for various reasons. For example, in U.S. Pat. No. 2,712,797 a bag like flexible container is disclosed mounted in a dump truck trailer wherein supporting means for collapsing the flexible container is provided such that the trailer can be used for bulk haulage of pourable material as well as for general hauling. U.S. Pat. No. 3,756,469 discloses a flexible liner used in a hopper vehicle, again where the flexible liner is supported within the trailer such that it is collapsible, allowing the trailer to be converted to general hauling. Other specialized applications for open topped trailer liners have been proposed such as in U.S. Pat. No. 4,186,845 wherein a foamed base sheet with polymeric top sheet is proposed for creating a tub within a trailer and U.S. Pat. Nos. 3,980,196 and 4,124,136 disclose flexible liners with framework and bulk head that essentially convert the trailer into a container for bulk cargo transport. Similarly, U.S. Pat. No. 3,951,287 discloses a flexible liner that is supported within a conventional semi-trailer by stretchable connectors along the trailer sidewalls that essentially convert the trailer to bulk material shipping.

In contrast to the prior art concept of using a flexible liner for bulk handling, theoretically there are other applications for use of a liner within a trailer provided such liner would be intrinsically extremely inexpensive, be readily and conveniently installed without essentially any down time or significant additional labor costs and provided that no other significant health hazard or risk is associated with its use. For example, it is known and generally tolerated in the trailer industry that certain types of common and ordinary goods statistically incur significant water damage associated with conventional transportation procedures independent of continuing efforts to prevent such shipping damage. In particular, moisture damage to cigarette and other tobacco products during transportation is known to be a troublesome problem in the industry, as is moisture and water damage to various paper products and paper related articles directly attributable to leaks in the semi-trailer. Although damages associated with such occurrences can be considered a significant statistical risk and cost from an insurance industry viewpoint, the actual effectiveness of correcting the problem by conventional methods (e.g., better packaging, sealing leaks in the trailer, etc.) is cost prohibitive relative to insuring the risk. In principle, an essentially disposable liner that could be selectively installed in a semi-trailer on an as needed basis would represent an ideal solution. To the best of the present inventor's knowledge, no one has proposed a method of installing an essentially stand-alone, disposable polyolefin film bag that could be installed in a semi-trailer on short notice and enclose the entire cargo.

SUMMARY OF THE INVENTION

The present invention disclosed and claimed herein comprises the method for installing a disposable liner within a cargo container. The method includes providing a cargo container having an opening and interior sides therefor. A cylindrical shaped bag open at one end is disposed within the container and the peripheral edges thereof attached to the peripheral edges of the opening in the container. A vacuum is then created in the space that exists between the sides of the bag and the inner sides of the container such that the sides of the bag are drawn toward the inner sides of the container. The vacuum is maintained until cargo is loaded into the bag and then the vacuum is removed. After removal of the vacuum, the peripheral edges of the bag opening are removed from the peripheral edges of the opening in the container and the bag closed to seal the cargo.

BRIEF DESCRIPTION OF THE DRAWINGS

For a more complete understanding of the present invention and the advantages thereof, reference is now made in the following description taken in conjunction with the accompanying Drawings in which:

FIG. 7 illustrates vacuum assist equipment installed in a semi-trailer before inflation of the liner; and FIG. 8 illustrates the method of the present invention utilizing only vacuum assist inflation of the liner.

DETAILED DESCRIPTION OF INVENTION

Figure 1:
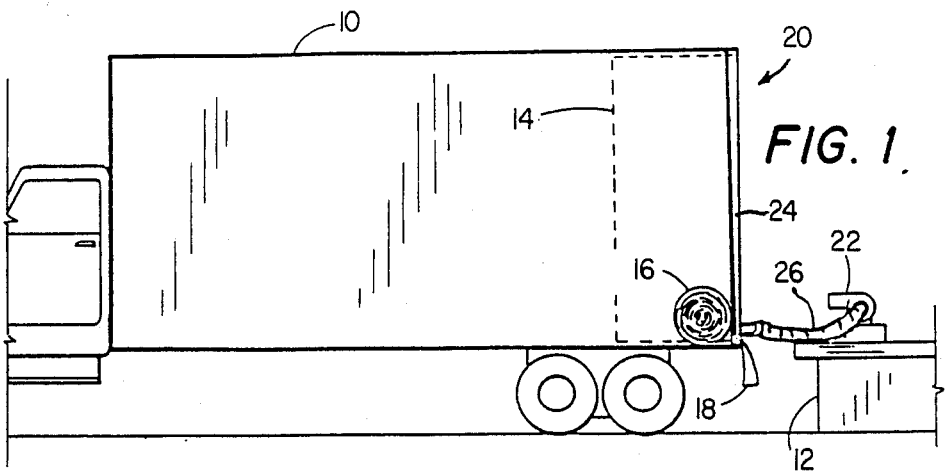
FIGS. 1 through 3 illustrate partial cross-sectional views illustrating the sequential steps associated with the method of the present invention for placing a stand alone, moisture proof liner in a semi-trailer.

The method of installing a waterproof liner according to the present invention can perhaps be best explained and understood by reference to the drawings. FIG. 1 illustrates a conventional semi-tractor trailer 10 backed up to a loading dock 12 with rear doors 14 of the trailer 10 opened for installation of the liner 16. As illustrated, liner 16 is initially in a deflated state and, in this embodiment, rolled up in a tight coil. The liner 16 is essentially a large plastic bag or inflatable bladder wherein the opening 18 of the liner is positioned at the doorway 20 of the trailer. The liner is then unrolled or unfolded and stretched out such that it extends along the floor of the trailer with the closed end at the back of the trailer and the open end of the bag extending out the doorway. An air blower 22 is positioned on the dock 12 and directed toward the back of the trailer 10 such as to be turned on later when inflating the liner 16.

Also, a pair of vertical vacuum tubes 24 (see FIG. 7) are inserted on the interior of the sidewalls at the rear of the semi-trailer near the hinged portion of the door 14. Each of the vacuum tubes 24 are connected via flexible hoses 26 to the suction side of blower 22. It should be appreciated that other physical configurations, equipment and methods of applying suction to the interior of the trailer or cargo container between the plastic liner and the container sidewalls can be employed in the present invention. As such, various suction tubes or other air channels can be readily incorporated into the present invention, including by way of example, but not limited thereto, horizontal tubes extending from the door of the trailer back into the rear of the container, air channels built into the sidewalls of the cargo container or trailer, horizontal suction tubes along the top and/or bottom of the doorway, and the like. It should be further appreciated that the vacuum tubes 24 of the drawing as well as any equivalent structure according to the present invention should be perforated (not shown) along the device such as to withdraw air potentially trapped between the expanding plastic liner and the sidewalls confining the liner.

Figure 2:
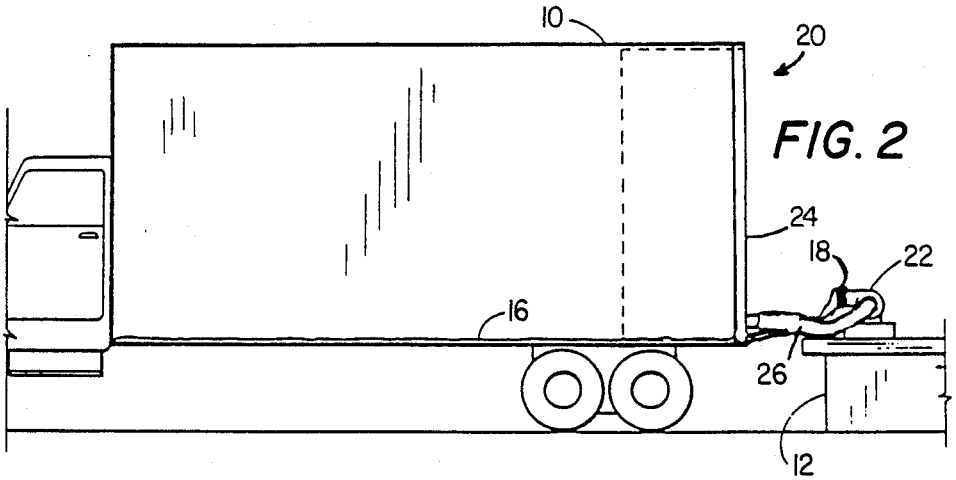

FIG. 2 illustrates liner 16 fully extended in the trailer 10 with the liner liner opening 18 being mounted directly to the air outlet side of the blower 22. Various alternative methods of attaching the liner 16 to the air supply can be employed. Thus, the opening 18 can be connected directly to the blower outlet as illustrated or can be attached to various types of nozzles, connectors or the like which in turn are fed air from a blower, air manifold or even compressed gas cylinder or other equivalent source. Similarly, it is envisioned that the vacuum tubes 24 can be physically attached through various types of nozzles, connectors, or the like, to any appropriate vacuum source, including the inlet side of the blower, or other equivalent low pressure device or equipment.

Figure 3:
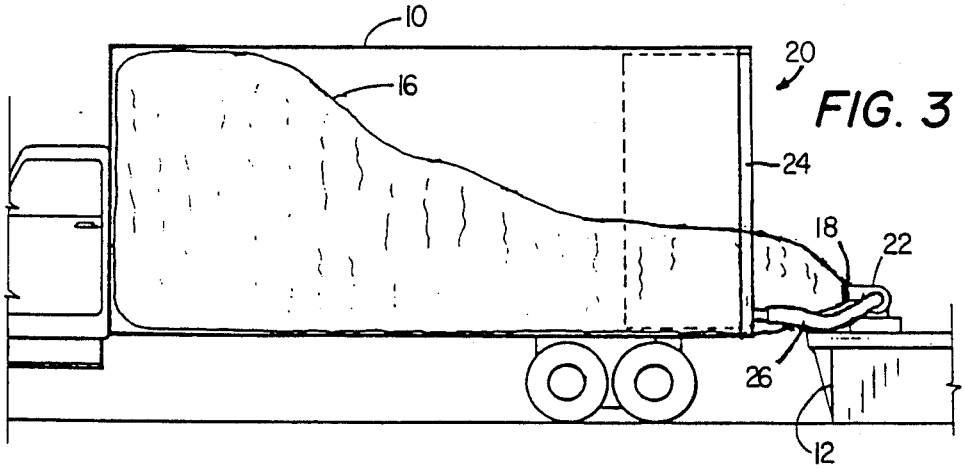

Having secured the opening 18 of the liner 16 to the blower 22, the blower 22 is then turned on and a gentle stream of air is directed into the liner 16. The air is selectively directed to the front of the trailer 10 (see FIG. 3) such that the liner 16 inflates to the ceiling of the trailer in the front portion of the trailer first. The blower 22 continues to gradually fill the liner 16 from the front of the trailer to the rear of the trailer. To assist in this critical inflation step, tension can be selectively applied to the upper surface of the liner 16 by manually pulling downward and outward on the upper edge of the liner opening 18, if necessary. Experience indicates that if the liner 16 is not inflated from the front to the rear, thus systematically displacing any trapped air behind the bag, the entire liner 16 will tend to exit the trailer during the inflation step. Experience further indicates that when applying sufficient suction to the region between the liner 16 and the confining sidewalls as the liner 16 inflates, the tendency of the liner 16 inside the trailer to be forced out of the trailer is significantly reduced.

In view of the above step, it is also critical that the dimensions of the liner 16 be selected such that it will fit the entire interior of the trailer. Preferably, the liner 16 is a cylindrically shaped bladder having a diameter slightly greater than the larger of the width or height of the inside of the trailer.

Figure 4:
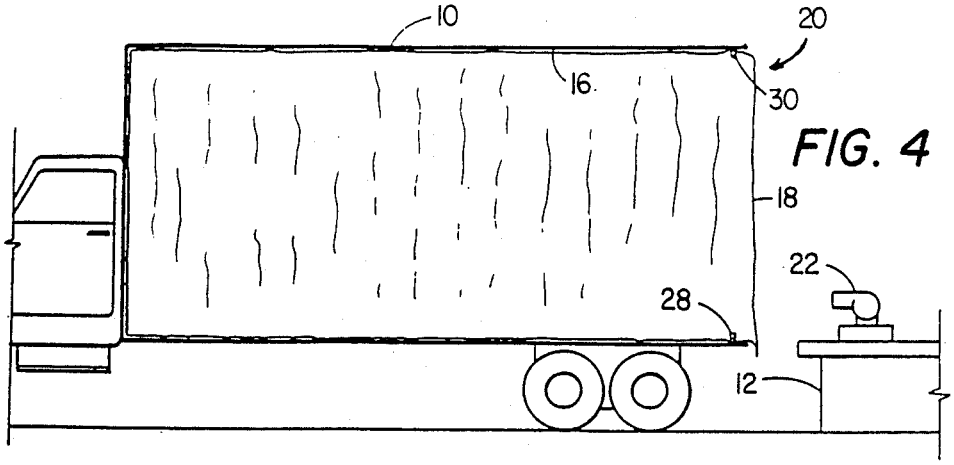
FIGS. 4 and 5 illustrate the free standing waterproof liner fully installed and ready for loading of the trailer.
Figure 5:
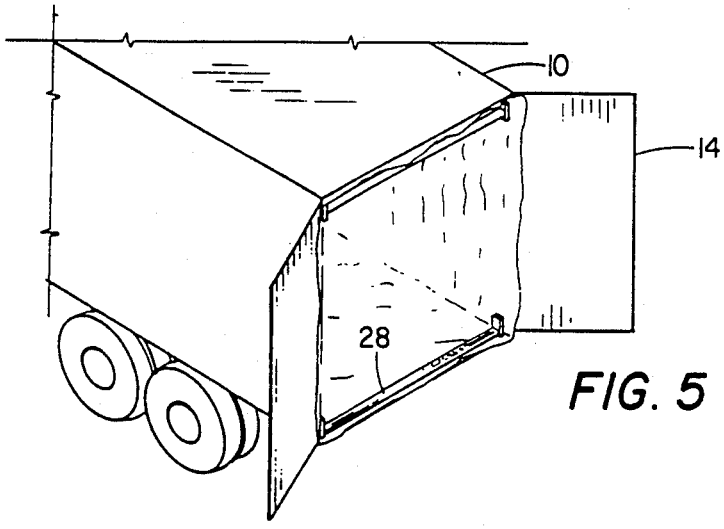
Figure 6:
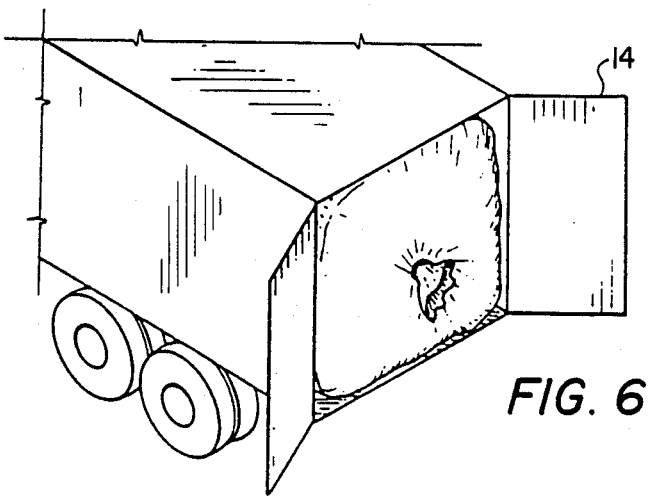
FIG. 6 illustrates the moisture proof liner sealed around the cargo of a loaded trailer.

As illustrated in FIGS. 4 and 5, once the liner 16 is fully inflated, the opening 18 can be removed from the air source and the liner 16 can be attached to the perimeter of the trailer doorway 20. In the specific embodiments of the drawing, the tension bars 28 and 30 are used to temporarily seal the bag opening 18 at the trailer doorway 20. Continued application of suction is an acceptable alternative to the use of tension bars. Also, any temporary sealing or fastening means or method well known in the art can be employed to temporarily attach the liner 16 to the doorway. The trailer is now ready to be loaded in a conventional manner. During loading, the blower may also remain in operation. However, the liner 16 once correctly inflated and sealed at the trailer doorway tends to remain in an inflated state for a considerable period of time, even without air or suction assist. After loading the cargo into the trailer, the blower is turned off and the excess liner material is wrapped around the end of the cargo and sealed such as to insure a moisture proof enclosure surrounding the entire cargo (see FIG. 6).

As previously stated, the liner 16 or inflatable protective bladder of the present invention is preferably a thin polymeric film bag of sufficient size to make contact upon inflation with the entire interior of the enclosure. It is contemplated that the liner 16 can be made of any of the conventional film grade polymeric compositions, including by way of example, but not limited thereto, polyolefins such as high density polyethylene, low density polyethylene, polypropylene and blends thereof, film grade vinyl polymers as well as natural polymeric materials such as cellulose type films. The class of polymeric film compositions that has been found to be particularly useful in the manufacturing of the plastic liner 16 are the film grade blends of high density polyethylene with low density polyethylene. The liner 16 is contemplated as being capable of being fabricated from a series of polymeric strips or sheets which are adhesively bonded or heat sealed along longitudinal seams to each other to form the liner 16. The liner 16 can also be extruded in a single sheet or cylindrical tube provided an extrusion dye of sufficient size is available. If longitudinal pieces are to be sealed together to make the bag, the use of a thicker film for the floor, along with color pigmentation and non-slip additives to identify the floor versus the sidewalls can be incorporated into the construction of the liner 16. Experience indicates that when polyolefins such as polyethylene blends are used, the liner 16 can be made out of a relatively thin film. A 2-mil polyethylene film has been successfully tested under conventional interstate commerce transportation conditions and has proved to be quite adequate for purposes of this invention. In fact, such liners have exhibited the ability to be reused if desired, but the inexpensive nature of the thin film would not necessitate reuse and is highly suggestive of disposing of the liner after one shipment.

The actual time, effort and equipment employed to install the liner is surprisingly nominal. Under conventional semi-trailer dock loading procedures and environment, the time required to actually inflate the liner 16 has been measured to be as short as 30 seconds. The procedure employed during this observation was essentially as illustrated in the drawing and involved air movement equivalent to that produced by a conventional air blower or air fan.

The use of polyolefin film liners of the present invention is particularly useful to protect tobacco products, paper products, foods and drugs, as well as other highly moisture sensitive cargo. The liners are also useful in shipping cargo that require ultra clean or an uncontaminated environment and could also be readily adapted to be used to maintain an inert vapor phase or gaseous environment. It is envisioned that the method of installing the film liner can be advantageously employed in semi-trailers, cargo containers or generally any equivalent transportation or storage facility wherein an inexpensive, throw-away plastic liner would be appropriate.

Referring now to FIG. 8, there is illustrated an alternate method for practicing the invention. The blower 22 is operated such that it only draws a vacuum through hose 26 from vacuum tubes 24. These vacuum tubes 24 in the preferred embodiment draw a vacuum along the sides of the interior of the trailer to evacuate a space 28 between the bag 16 and the trailer body 10. The trailer body 10 is essentially a semi-sealed enclosure such that a negative pressure is created in space 28 when a vacuum is drawn through hose 26 by blower 22. The vacuum or negative pressure in space 28 causes the bag 16 and the surfaces thereof to raise upward against the sides of the trailer body 10 due to atmospheric pressure existing on the interior of the bag 16. In order to provide a sufficient seal for space 28, the edges of the bag 16 proximate to the periphery of the trailer are attached by clamps 32 to the edge of the trailer. The clamps are any type of C-type clamp which can grip the edge of the peripheral rim of the trailer.

In operation, the bag is first laid out in the conventional manner, as described above, in the trailer and then the peripheral edge at the opening of the bag is attached to the peripheral edge of the trailer opening. These edges are then clamped to provide a seal and then the blower 22 is turned on to produce a negative pressure in space 28. This causes the sides of the bag 16 to rise upward against the inside surfaces of the trailer body 10. However, it is not necessary for the bag to actually touch all sides of the trailer. It is therefore unnecessary to have the air blowing in the interior of the bag to create a positive pressure on the inner surfaces and, therefore, the operation is significantly simplified.

Although the preferred embodiment has been described in detail, it should be understood that various changes, substitutions and alterations can be made therein without departing from the spirit and scope of the invention as defined by the appended claims.

What is claimed is:

1. A method for installing a liner, comprising:

providing a horizontal container having one open end and interior sides with defined interior dimensions to allow loading through the one opening;

providing a deflated moisture proof film liner of dimensions slightly in excess of the interior dimensions of the container and having an opening that corresponds to the container opening;

disposing the peripheral edges of the opening of the liner adjacent the peripheral edges of the opening of the container and adhering the peripheral edges of the opening of the liner to the peripheral edges of the opening in the container;

disposing outlet tubes adjacent the peripheral edges of the opening of the container in communication with the space between the interior of the container and the exterior surfaces of the liner such that the peripheral edges of the opening of the liner provide a vacuum outlet; and providing a blower in communication with the vacuum for removing the air from the space between the liner and the container to create the vacuum;

loading material into the interior of the liner; and closing the opening in the liner to seal the loaded material therein.

2. The method of claim 1 wherein the step of loading material and closing the opening comprise;

disposing cargo in the interior of the liner after the exterior surface of the liner has moved proximate the interior sides of the container; and removing the peripheral edges of the opening of the liner from being adjacent the peripheral edges of the opening of the container and closing the opening on the liner to seal the cargo.

3. A method for installing a liner, comprising:

providing a horizontal container with internal surfaces and an opening for loading from a horizontal surface;

providing a waterproof liner having an inner surface and an outer surface with an opening at one end, the opening in the waterproof liner being at least equal to the opening in the container;

disposing the waterproof liner in the interior of the container;

attaching the peripheral edge of the opening in the waterproof liner to the peripheral edges of the opening in the container to form a seal therewith;

disposing a vacuum manifold between the peripheral edge of the waterproof liner and the peripheral edges of the opening in the container;

attaching a vacuum source to the vacuum manifold to continually remove air therethrough such that any leaks about the seal from between the peripheral edges of the opening of the waterproof liner and the peripheral edges of the opening of the container are accounted for, the vacuum source causing the exterior surfaces of the waterproof liner to move outward toward the interior surfaces of the container to form an opening in the interior of the waterproof liner;

loading material into the interior of the liner; and closing the opening in the liner to seal the loaded material therein.

4. The method of claim 3 wherein the steps of loading material and closing the opening comprise:

loading material into the interior of the waterproof liner after air has been removed from the space between the interior of the container and the exterior of the waterproof liner;

breaking the seal between the peripheral edges of the opening in the waterproof liner and the opening of the container; and closing the opening in the waterproof liner.

5. The method of claim 3 wherein the waterproof liner has dimensions essentially equal to the interior dimensions of the container.

6. The method of claim 3 wherein the container has four interior surfaces and one end surface.

7. The method of claim 3 wherein the step of attaching the peripheral edges of the opening of the waterproof liner to the peripheral edges of the opening of the container comprises attaching the peripheral edges of the opening in the waterproof liner to the peripheral edges of the opening in the container with clamps about the vacuum outlet.

8. A method for installing a liner, comprising:

providing a container with internal surfaces and an opening at one end for horizontal loading through the opening;

providing a waterproof liner having an inner surface and outer surface with an opening at one end, the opening of the waterproof liner at least equal to the opening in the container and the waterproof liner having dimensions when expanded essentially equal to or exceeding the dimensions of the container such that when opened the waterproof liner will have the exterior surface thereof proximate to the interior surface of the container;

disposing the waterproof liner in the interior of the container on the bottom surface thereof;

attaching the peripheral edges of the opening in the waterproof liner to the peripheral edges of the opening in the container to form a seal therewith;

attaching a vacuum manifold to a portion of the peripheral edges of the opening in the container and between the corresponding peripheral edges of the opening in the waterproof liner to create a vacuum outlet;

creating a vacuum in the space between the interior of the container and the exterior of the waterproof liner by attaching a vacuum source to the vacuum outlet to cause a pressure differential across the exterior and interior surfaces of the liner such that the exterior surfaces of the liner move outward toward the interior surfaces of the container and adjacent therewith with the upper surface of the liner being lifted upward, toward the upper interior surface of the container to form an opening in the interior of the waterproof liner;

loading material into the interior of the waterproof liner;

breaking the seal between the peripheral edges of the opening on the waterproof liner and the opening of the container; and closing the opening in the waterproof liner to seal the loaded material therein.

* * * * *